US006769655B2

(12) United States Patent
Beese

(10) Patent No.: US 6,769,655 B2
(45) Date of Patent: Aug. 3, 2004

(54) WORKSTATION PANEL LIFTING BRACKET

(76) Inventor: Glenn Beese, 38W005 Spring Green Way, Batavia, IL (US) 60510

( * ) Notice: Subject to any disclaimer, the term of this patent is extended or adjusted under 35 U.S.C. 154(b) by 0 days.

(21) Appl. No.: 10/172,917

(22) Filed: Jun. 17, 2002

(65) Prior Publication Data

US 2003/0230682 A1 Dec. 18, 2003

(51) Int. Cl.[7] ..... B66F 3/00

(52) U.S. Cl. ..... 248/188.91; 248/200; 248/188.1; 254/100; 254/133 R

(58) Field of Search ..... 248/188.1, 300, 248/342, 343, 200, 125.1, 440, 188.91; 254/100, 133 R, 134

(56) References Cited

U.S. PATENT DOCUMENTS

| | | | | | |
|---|---|---|---|---|---|
| 435,531 | A | * | 9/1890 | Virtue | |
| 974,988 | A | | 11/1910 | Northam | |
| 2,010,679 | A | | 8/1935 | Rosenberry et al. | |
| 2,028,905 | A | * | 1/1936 | Hein | 254/93 |
| 2,469,670 | A | | 5/1949 | Thompson | |
| 3,047,269 | A | | 7/1962 | Renshaw | |
| 3,300,183 | A | * | 1/1967 | Marshall, Jr. | 254/133 |
| 3,662,994 | A | * | 5/1972 | Johns | 254/93 R |
| 4,058,952 | A | * | 11/1977 | Donnelly | 52/741 |
| 4,194,726 | A | | 3/1980 | Hance | |
| 4,715,760 | A | | 12/1987 | Browning | |
| 4,846,443 | A | | 7/1989 | Collins et al. | |
| 5,131,629 | A | | 7/1992 | Hillhouse | |
| D329,372 | S | * | 9/1992 | Wilms | D8/380 |
| 5,221,067 | A | * | 6/1993 | Burchell et al. | 248/222.2 |
| 5,356,201 | A | * | 10/1994 | Olson | 297/352 |
| 5,379,987 | A | | 1/1995 | Cleary | |
| 5,855,360 | A | | 1/1999 | Wurdack | |
| 5,860,763 | A | * | 1/1999 | Asplin | 404/78 |
| 5,915,670 | A | | 6/1999 | Cain | |
| 5,979,879 | A | * | 11/1999 | Asplin | 254/133 R |
| 6,471,187 | B1 | * | 10/2002 | Dube et al. | 254/134 |
| 6,547,478 | B1 | * | 4/2003 | Lin | 403/339 |
| 6,554,175 | B1 | * | 4/2003 | Thompson | 228/112.1 |

* cited by examiner

*Primary Examiner*—Leslie A. Braun
*Assistant Examiner*—Steven Marsh
(74) *Attorney, Agent, or Firm*—Polster, Lieder, Woodruff & Lucchesi L.C.

(57) ABSTRACT

A workstation panel lifting bracket is adapted to be mounted to a jack to raise a workstation panel off the floor a sufficient distance to allow for access beneath the panel. The bracket comprises a generally horizontal top plate that is adapted to be mounted to the jack. A leg extends downwardly and forwardly from a forward edge of the top plate. Preferably, the leg forms an angle of about 80° to about 85° with the bracket top plate. A foot extending forwardly from a bottom end of the leg. An upwardly turned lip is preferably formed at the end of the foot. To provide stability to the bracket, jack, and panel during raising and lowering of the panel, the bracket also include a brace on the leg. The brace has a front surface and opposed side surfaces. The side surfaces are generally triangular in shape, and the brace front surface is in a plane substantially perpendicular to a plane of said top plate. Preferably, the brace front face is approximately as long as the leg.

11 Claims, 3 Drawing Sheets

WORKSTATION PANEL LIFTING BRACKET

BACKGROUND OF THE INVENTION

This invention relates to lifting brackets for use in lifting workstation panels to facilitate access beneath the panel, for example, for carpeting, wiring, etc.

Many offices use workstations made from a plurality of panels that are secured together to create private or partially enclosed spaces for their employees. These workstations sit on the carpet or other flooring in the office and typically are wired to connect a computer at the workstation to a network in the office. When the office is redecorated, such as by recarpeting the office, the workstations must be moved to allow the carpet installer access underneath the workstation. This generally requires that the workstation be disassembled during the recarpeting and then reassembled after the recarpeting. As can be appreciated, disassembling all the workstations that might be in an office can be quite disruptive. It would be beneficial if carpeters or the like could gain access beneath the workstations without the need to disassemble the workstations. It would be equally beneficial to allow for easy access to cabelers (i.e. for laying computer network cables) to the area beneath a workstation when laying cables for a computer network or telephone systems, or simply to provide electricity to the workstation.

BRIEF SUMMARY OF THE INVENTION

A workstation panel lifting bracket of the present invention is adapted to be mounted to a jack to raise a workstation panel off the floor a sufficient distance to allow for access beneath the panel, for example, to lay flooring or carpeting, or to provide wiring (computer, telephone, electrical, etc.) to the workstation. The bracket comprises a generally horizontal top plate that is adapted to be mounted to the jack. A leg extends downwardly and forwardly from a forward edge of the top plate. Preferably, the leg forms an angle of about 80° to about 85° with the bracket top plate. A foot extending forwardly from a bottom end of the leg. An upwardly turned lip is preferably formed at the end of the foot. To provide stability to the bracket, jack, and panel during raising and lowering of the panel, the bracket also include a brace on the leg. The brace has a front surface and opposed side surfaces. The side surfaces are generally triangular in shape, and the brace front surface is in a plane substantially perpendicular to a plane of said top plate. Preferably, the brace front face is approximately as long as the leg.

The bracket can also be provided with a reinforcing member at a bottom of the leg. The reinforcing member includes a first leg and a second leg. The reinforcing member first leg is fixed to the bracket leg and extends below the end of the bracket leg. The reinforcing member second leg extends from a bottom of the first leg to the bracket foot. Preferably, the second leg engages the foot near the forward or free end of the foot.

In the illustrative embodiment shown in the drawings and described below, the bracket top plate includes an opening. The jack includes an axially movable cylinder with a button raised above the top of the cylinder by a rod. To mount the plate to the jack, the plate is positioned over the jack button, such that the hole surrounds the jack rod. A collar is then positioned around the jack rod between the bracket top plate and the cylinder button.

BRIEF DESCRIPTION OF THE SEVERAL VIEWS OF THE DRAWINGS

Corresponding reference numerals will be used throughout the several figures of the drawings.

DETAILED DESCRIPTION OF THE INVENTION

Figure 1:
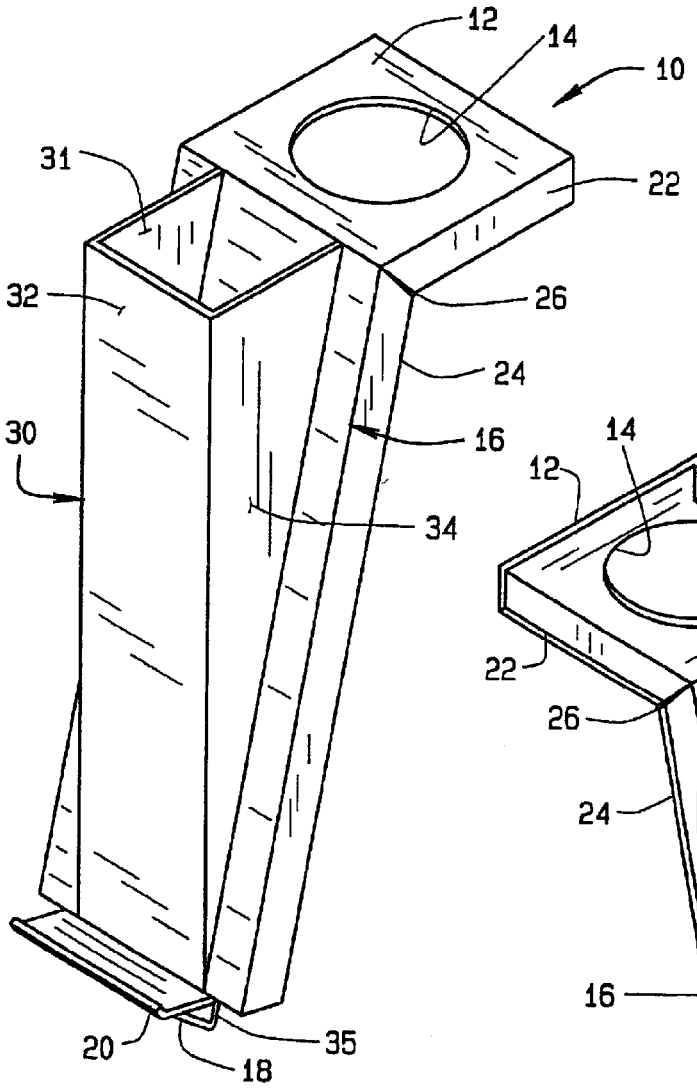
FIG. 1 is a front perspective view of a bracket of the present invention.
Figure 2:
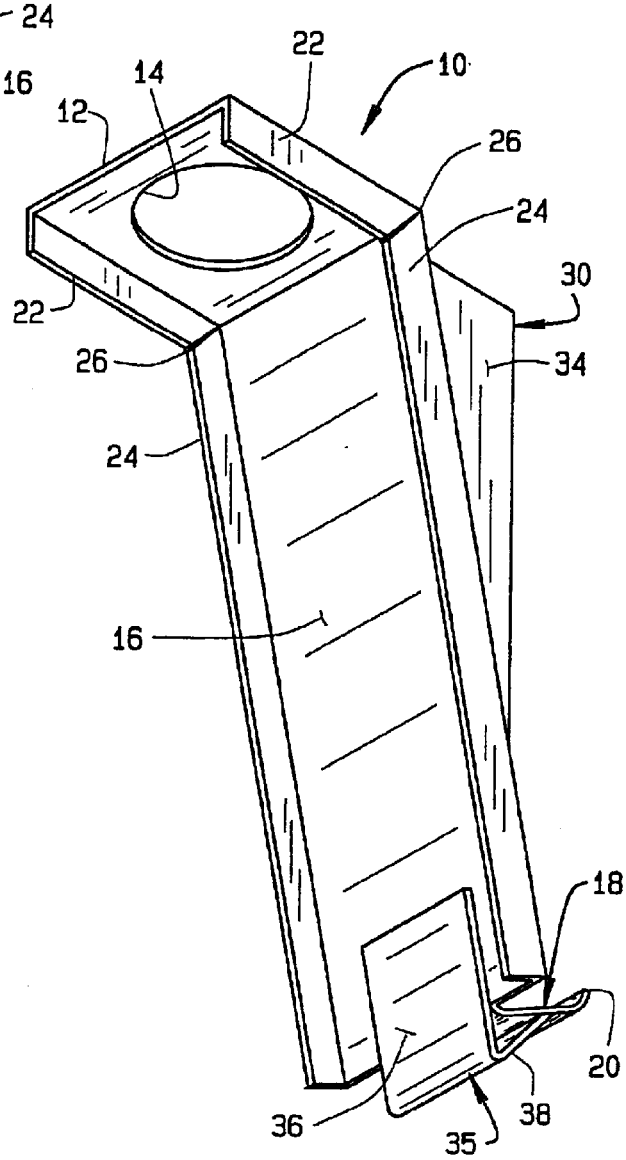
FIG. 2 is a rear perspective view of the bracket.
Figure 3:
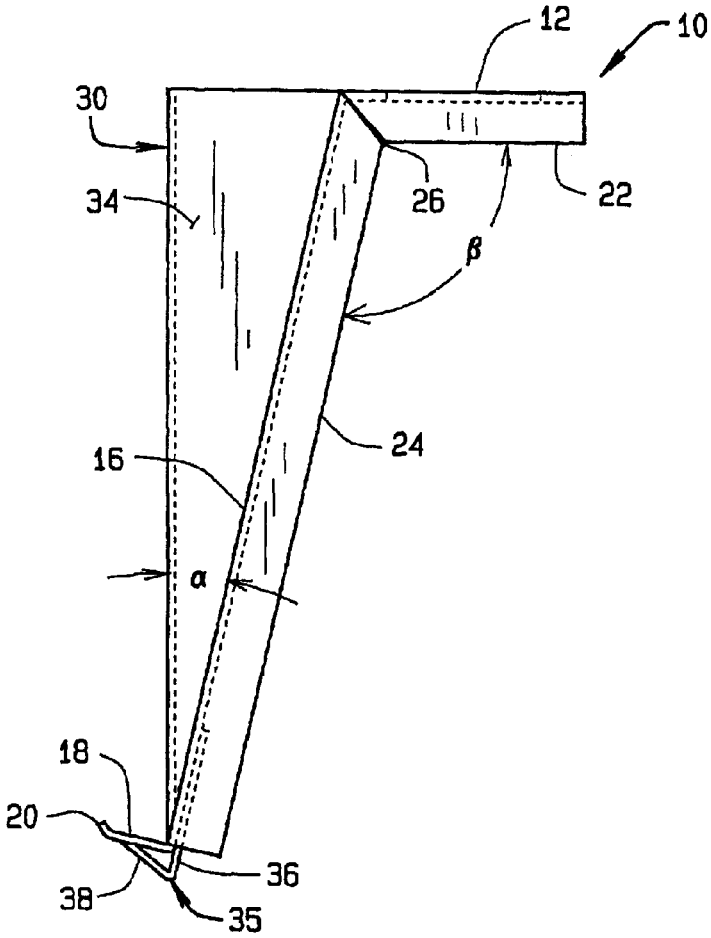
FIG. 3 is a side elevational view of the bracket.
Figure 4:
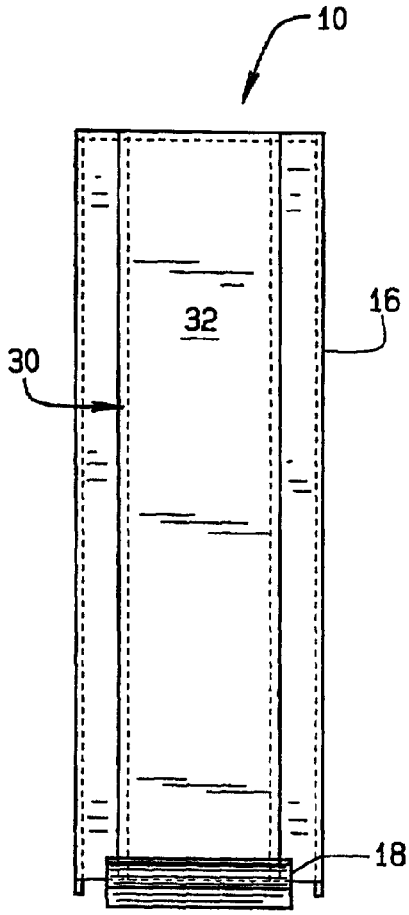
FIG. 4 is a front elevational view of the bracket.

The following detailed description illustrates the invention by way of example and not by way of limitation. This description will clearly enable one skilled in the art to make and use the invention, and describes several embodiments, adaptations, variations, alternatives and uses of the invention, including what I presently believe is the best mode of carrying out the invention. Additionally, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

Referring generally to FIGS. 1–5, a bracket 10 of the present invention includes a horizontal top plate 12 having an opening 14 formed therein. A leg 16 extends from the forward end of the plate 12. The leg 16 is not perpendicular to the plate 12. Rather, if forms an angle of about 80°–85° with the plate 12. At the bottom of the leg 16, the bracket 10 includes a foot 18 which is perpendicular to the leg 16. A small upwardly turned lip 20 is formed at the end of the foot 18. Sidewall 22 extends downwardly from the side edges of the plate 12 and sidewalls 24 extend rearwardly from the side edges of the leg 16. The side walls 22 and 24 are preferably welded together at their junction, as at 26. The plate 12, leg 16, foot 18, lip 20, and side walls 22 and 24 are preferably formed from a single sheet of metal in a bending operation. In one preferred embodiment, the vertical height of the bracket (from the bottom of the foot to the top plate 12) is either 5" or 9"; and the side walls are ⅝". The foot 18 is narrower than the leg, and there is a space or gap between the side edges of the foot and the side edges of the leg. In a preferred embodiment, the space or gap is about ⅜" wide on either side of the foot (that is, the foot is preferably centered with respect to the leg). The foot 18 is about ⅞" deep—which is deep enough to enable the foot to fit under most standard cubicle or workstation panels sufficiently to enable the panel to securely rest on the foot during raising and lowering of the workstation panel. Although these dimensions are preferred, other dimensions could be used as well.

A bracing member 30 is fixed to the front surface of the leg. The bracing member is sized to extend the length of the leg, and includes a front surface 32 and side surfaces 34. The side surfaces are triangularly shaped, and the angle $\alpha$ at the apex of the triangle (at the base of the leg) is such that the brace front surface 32 will be substantially vertical (and hence substantially perpendicular to the bracket plate 12. Thus, the angle $\alpha$ is complementary to the angle $\beta$ between the plate 12 and the leg 16, and is preferably about 15°–20°.

Figure 5:
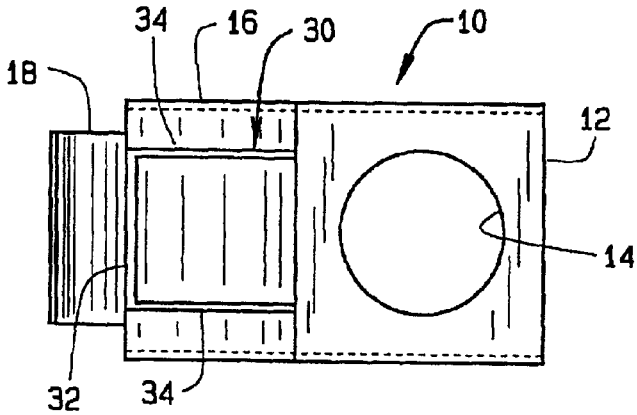
FIG. 5 is a top plan view of the bracket.

As seen in FIG. 5, the brace 30 is hollow, and is generally U-shaped in top plan. Additionally, the brace 30 is slightly narrower than the bracket foot 18 and is preferably centered on the leg 16.

A steel reinforcement 35 can be fixed to the bracket 10 to reinforce the foot 18. The reinforcement 35 includes a first leg 36 which is secured to the back surface of the leg 16 and extends below the bottom of the leg 16. A second leg 38, which forms an acute angle with the first leg 36 extends forwardly and upwardly from the bottom of the first leg to engage the foot 18 slightly rearwardly of the lip 20.

Figure 6:
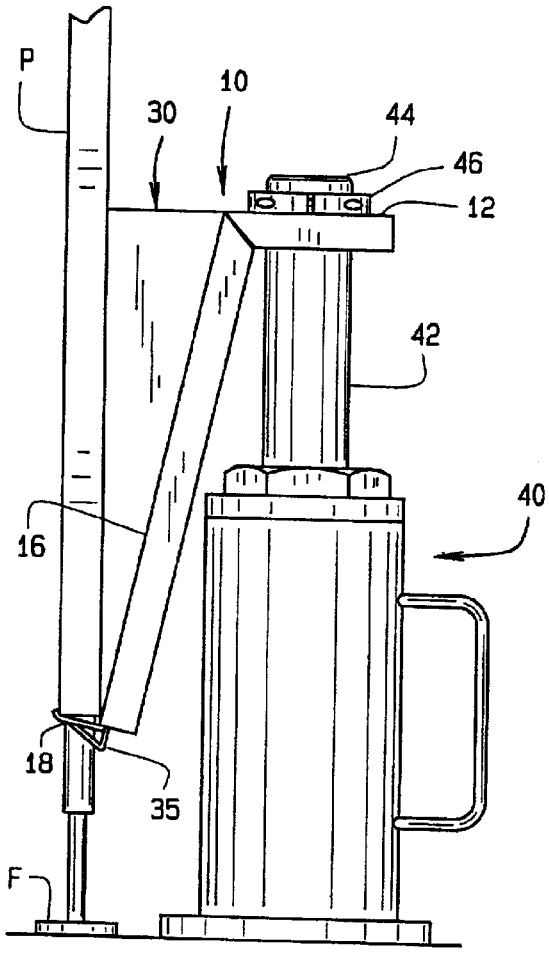
FIG. 6 is a side elevational view of the bracket mounted on a jack, in place to raise a panel.
Figure 7:
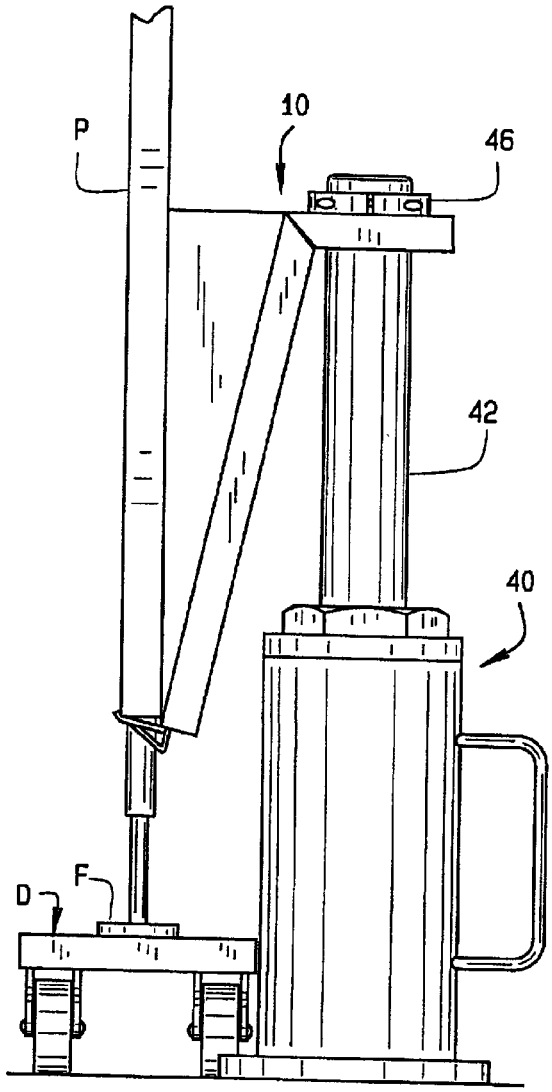
FIG. 7 is a view similar to FIG. 6, but with the panel raised, and a dollie inserted beneath the legs of the panel.

Turning to FIGS. 6 and 7, the jack 40 includes a cylinder 42, and is shown to have a button 44 on the top of the cylinder 42. The jack 40 can be any desired type of jack—it can be hydraulically or pneumatically actuated, or it can be manually actuated (in the same manner as a car jack). The button 44 is smaller in diameter than the cylinder 42, and is spaced above the cylinder by a rod (not shown). The bracket 10 is mounted to the jack 40 by placing the bracket top plate on the top of the cylinder 42. Hence, the top plate opening 12 has a diameter greater than the button, but smaller than the cylinder. Preferably, the plate opening 12 is 1¾" in diameter, however, this can be changed as necessary to be used with a desired jack. A two-piece collar 46 is positioned about the rod between the top of the bracket plate 12 and the bottom of the cylinder button 44. The two pieces of the collar can be secured together in any conventional manner.

In operation, once the bracket 10 is mounted on the jack 40, the bracket is positioned adjacent the workstation panel P to be raised. The jack is then raised, as seen in FIG. 6, until the bracket foot has engaged the bottom of the workstation panel. In this position, as can be seen, the leg 16 extends forwardly of the top plate 12, and the panel P abuts the brace 30 along the front face 32 of the brace. Then, the jack is operated to raise the panel P, as seen in FIG. 7, for example, to a height sufficient to place a dollie D beneath the feet F of the work station panel. If a pneumatic or hydraulic jack is used, then several jacks can be positioned about the several panels of a workstation (or a series of interconnected workstations), and the jacks can be connected to a single source of air or fluid such that the jacks all raise the workstation at the same rate. This will maintain the workstation generally level during a lifting process.

As can be appreciated, the bracket side walls 22 and 24 rigidify the bracket. Further, angling the leg 16 outwardly from the top plate 12, and then using the bracing member 30, has been found to help stabilize the bracket and the panel during raising and lowering of the panel.

As various changes could be made in the above constructions without departing from the scope of the invention, it is intended that all matter contained in the above description or shown in the accompanying drawings shall be interpreted as illustrative and not in a limiting sense. Depending on the type of jack used, the manner of connection to the top of the jack cylinder may vary. Hence, the top plate opening 14 could be replaced with a different means for mounting the bracket to the cylinder. For example, the cylinder could have a flat top with a bore extending downwardly from the top of the cylinder. In this case, the bracket top plate opening would be reduced in sized to be approximately the size of the cylinder bore, and a headed pin could be placed through the top plate opening and the cylinder bore. Alternatively, the top plate opening could be removed, and a rod could extend from the bottom of the top plate. This rod would then be received in the cylinder bore. In another alternative, the bracket top plate could be provided with a sleeve which fits over the cylinder. If desired, pins could pass through the sleeve and into (or through) the cylinder, to provide a more secure connection of the bracket to the cylinder. These examples are merely illustrative.

What is claimed is:

1. A workstation panel lifting bracket comprising:

a generally horizontal top plate;

a leg extending downwardly and forwardly from a forward edge of said top plate;

a foot extending forwardly from a bottom end of said leg;

a brace on said leg; said brace having a front surface and side surfaces; said side surfaces being generally triangular in shape, and said brace front surface being in a plane substantially perpendicular to a plane of said top plate; and a reinforcing member at a bottom of said leg; said reinforcing member including a first leg and a second leg; said reinforcing member first leg being fixed to said bracket leg and extending below said bracket leg; and said reinforcing member second leg extending from a bottom of said first leg to said bracket foot.

2. The bracket of claim 1 wherein said leg forms an angle of about 80° to about 85° with said top panel.

3. The bracket of claim 1 wherein said reinforcing member second leg extends to a point near a free end of said foot.

4. The bracket of claim 1 wherein said bracket includes an upwardly turned lip at a free end of said foot.

5. The bracket of claim 1 wherein said top plate is adapted to be connected to a cylinder of a jack.

6. The bracket of claim 1 wherein said top plate is adapted to be connected to a cylinder of a jack.

7. In combination, a jack and a workstation panel lifting bracket mountable on said jack;

said jack comprising an axially movable cylinder;

said bracket comprising:

a generally horizontal top plate adapted to be mounted to said jack cylinder;

a leg extending downwardly and forwardly from a forward edge of said top plate;

a foot extending forwardly from a bottom end of said leg; and a brace of said leg; said brace having a front surface and side surfaces; said side surfaces being generally triangular in shape, and said brace front surface being in a plane substantially perpendicular to a plane of said top plate; and a reinforcing member at a bottom of said leg; said reinforcing member including a first leg and a second leg; said reinforcing member first leg being fixed to said bracket leg and extending below said bracket leg; and said reinforcing member second leg extending from a bottom of first said leg to said bracket foot.

8. The combination of claim 7 wherein said jack cylinder has a top surface; said jack including a rod extending upwardly from said cylinder and having a button at the top of said rod; said button having a diameter greater than said rod, but less than said cylinder; said bracket top plate having an opening therein, said opening having a diameter greater than said button, but less than said cylinder, such that said bracket top plate opening can fit over said cylinder button; said combination further including a collar mountable about said cylinder rod between said bracket top plate and said button.

9. The combination of claim 7 wherein said leg forms an angle of about 80° to about 85 ° with said top panel.

10. The combination of claim 7 wherein said reinforcing member second leg extends to a point near a free end of said foot.

11. The combination of claim 7 wherein said bracket includes an upwardly turned lip at a free end of said foot.

* * * * *

UNITED STATES PATENT AND TRADEMARK OFFICE

CERTIFICATE OF CORRECTION

PATENT NO. : 6,769,655 B2
DATED : August 3, 2004
INVENTOR(S) : Glenn Beese

It is certified that error appears in the above-identified patent and that said Letters Patent is hereby corrected as shown below:

Column 4,
Line 37, replace “of” with -- on --

Signed and Sealed this

Twenty-sixth Day of April, 2005

JON W. DUDAS
*Director of the United States Patent and Trademark Office*